US005088410A

United States Patent [19]

Murakami

[11] Patent Number: 5,088,410

[45] Date of Patent: Feb. 18, 1992

[54] PLATE LOCKUP APPARATUS FOR PRINTING PRESS

[75] Inventor: Toshiyuki Murakami, Ibaraki, Japan

[73] Assignee: Komori Corporation, Tokyo, Japan

[21] Appl. No.: 702,240

[22] Filed: May 17, 1991

[30] Foreign Application Priority Data

May 25, 1990 [JP] Japan ..... 2-54156[U]

[51] Int. Cl.[5] ..... B41F 1/28; B41F 21/00

[52] U.S. Cl. ..... 101/415.1; 51/364; 51/367; 51/368; 51/370; 101/378

[58] Field of Search ..... 101/415.1, 378, 379, 101/408, DIG. 36; 51/364, 367, 368, 370

[56] References Cited

U.S. PATENT DOCUMENTS

| | | | |
|---|---|---|---|
| 3,151,553 | 10/1964 | Norton | 101/415.1 |
| 3,752,075 | 8/1973 | Fusco | 101/415.1 |
| 4,010,685 | 3/1977 | Trageser | 101/415.1 |
| 4,739,704 | 4/1988 | Kitai | 101/415.1 |
| 4,785,736 | 11/1988 | Jeschke | 101/415.1 |
| 4,848,229 | 7/1989 | Grosshauser et al. | 101/415.1 X |

*Primary Examiner*—David A. Wiecking
*Assistant Examiner*—Moshe I. Cohen
*Attorney, Agent, or Firm*—Blakely, Sokoloff, Taylor & Zafman

[57] ABSTRACT

A plate lockup apparatus for a printing press includes leading- and trailing-side plate lockup tables, leading- and trailing-side gripper plates, a plurality of plate gripper cams, spring members, and plate tightening cams. The leading- and trailing-side plate lockup tables axially extend on one side and the other side in a gap of a circumferential surface of a plate cylinder. The leading- and trailing-side gripper plates are pivotally supported to oppose the leading- and trailing-side plate lockup tables and are biased in a plate release direction. The plurality of plate gripper cams are mounted on a plate tightening pivot shaft and a trailing-side pivot shaft parallel to the leading- and trailing-side gripper plates at equal intervals and pivot the leading- and trailing-side gripper plates in a plate gripping direction upon pivotal movement of the pivot shafts. The spring members are interposed between the trailing-side plate lockup table and a wall surface of the gap and bias the trailing-side plate lockup table in a plate tightening direction. The plate tightening cams are mounted on the trailing-side pivot shaft and moves the trailing-side plate lockup table against the biasing forces of the spring members in a plate loosening direction.

6 Claims, 2 Drawing Sheets

PLATE LOCKUP APPARATUS FOR PRINTING PRESS

BACKGROUND OF THE INVENTION

The present invention relates to a plate lockup apparatus, arranged in a plate cylinder of a printing press, for fixing leading and trailing ends of a plate wound around the circumferential surface of the plate cylinder.

A gap having almost a rectangular section and a length almost equal to the overall length of a plate cylinder is formed in the circumferential surface of the plate cylinder for each of a variety of printing presses. A plate lockup apparatus consisting of a leading-side lockup device for fixing the leading end of a plate and a trailing-side lockup device for fixing the trailing end of the plate is axially fixed on the bottom surface of the gap.

Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table, and a plurality of cams which can be respectively engaged with gaps at the edges of the gripper plates. The plurality of cams are pivotally aligned along the axis. A plurality of compression coil springs are interposed between the lockup table and the gripper plates to bias the gripper plates in an open direction.

With the above arrangement, in order to mount a plate on a plate cylinder, when a cam shaft of the leading-side lockup device is pivoted, the gripper plates which are divided in the axial direction of the plate are released upon disengagement from the cams and are simultaneously opened by the elastic forces of the compression coil springs. An end of the plate is inserted between the leading-side lockup device and the corresponding lockup table. When the cam plate is pivoted in the direction opposite to the direction described above, the gripper plates are pivoted against the elastic forces of the compression coil springs by the behavior of the cams and are closed, thereby gripping the leading end of the plate.

The lockup table of the trailing-side lockup device is supported on the bottom surface of the circumferential gap of the plate cylinder to be movable in the circumferential direction of the plate cylinder. A plurality of plate tightening bolts are mounted at a plurality of longitudinal positions of the lockup table so that distal ends of the bolts are in contact with the wall surface of the circumferential gap of the plate cylinder.

With the above arrangement, the leading end of the plate is gripped by the leading-side lockup device as described above, the plate is wound around the circumferential surface of the plate cylinder, and the trailing end of the plate is gripped by the trailing-side lockup device. Thereafter, the tightening bolts are tightened to move the trailing-side lockup device in the circumferential direction of the plate cylinder, so that the plate is brought into tight contact with the circumferential surface of the plate cylinder. Note that since spring members are interposed between the trailing-side lockup device and the gap, the plate lockup device is moved toward the wall surface of the gap by the spring forces of the spring members upon loosening of the tightening bolts, thereby loosening the plate.

In the conventional plate lockup apparatus described above, since the plate is tightened by tightening the plurality of tightening bolts, it is difficult to uniformly tighten the plate to degrade plate mounting precision. Plate tightening and plate gripping at each operation position are cumbersome and time-consuming.

SUMMARY OF THE INVENTION

It is an object of the present invention to provide a plate lockup apparatus for a printing press, capable of uniformly tightening a plate and improving plate mounting precision.

It is another object of the present invention to provide a plate lockup apparatus for a printing press, capable of performing plate tightening and plate gripping at one position.

It is still another object of the present invention to provide a plate lockup apparatus for a printing press, capable of performing plate tightening and plate gripping within a short period of time.

In order to achieve the above objects of the present invention, there is provided a plate lockup apparatus for a printing press, comprising a leading-side plate lockup table axially extending on one side in a gap of a circumferential surface of a plate cylinder and a trailing-side plate lockup table axially extending on the other side in the gap of the circumferential surface of the plate cylinder, leading- and trailing-side gripper plates pivotally supported to oppose the leading- and trailing-side plate lockup tables and biased in a plate release direction, a plurality of plate gripper cams, mounted on a plate tightening pivot shaft and a trailing-side pivot shaft parallel to the leading- and trailing-side gripper plates at equal intervals, for pivoting the leading- and trailing-side gripper plates in a plate gripping direction upon pivotal movement of the pivot shafts, spring members, interposed between the trailing-side plate lockup table and a wall surface of the gap, for biasing the trailing-side plate lockup table in a plate tightening direction, and plate tightening cams, mounted on the trailing-side pivot shaft, for moving the trailing-side plate lockup table against the biasing forces of the spring members in a plate loosening direction.

When the leading-side pivot shaft is turned after one end of a plate is inserted between the open leading-side plate lockup device and the plate lockup table, the gripper plates are engaged with large-diameter portions of the gripper cams to grip the plate. After one end of the plate is gripped as described above, the plate is wound around the circumferential surface of the plate cylinder. The other end of the plate is inserted between the open trailing-side plate lockup device and the plate lockup table. The trailing-side pivot shaft is turned to engage large-diameter portions of the gripper cams with the gripper plates to grip the plate.

When the trailing-side pivot shaft is turned, the plate tightening cams are pivoted so that their small-diameter portions are engaged with the gripper plates, and the trailing-side plate lockup device as a whole can be moved. The trailing-side plate lockup device is biased by the spring members to tighten the plate and bring the plate into tight contact with the circumferential surface of the plate cylinder.

BRIEF DESCRIPTION OF THE DRAWINGS

FIGS. 1 to 3 show an embodiment of a plate lockup apparatus for a printing press according to the present invention, in which:

FIG. 1 is a plan view of a plate cylinder having the plate lockup apparatus;

FIG. 2 is a sectional view of the plate cylinder along the line II—II of FIG. 1; and FIG. 3 is a sectional view of the plate cylinder along the line III—III of FIG. 1.

DESCRIPTION OF THE PREFERRED EMBODIMENT

Figure 1:
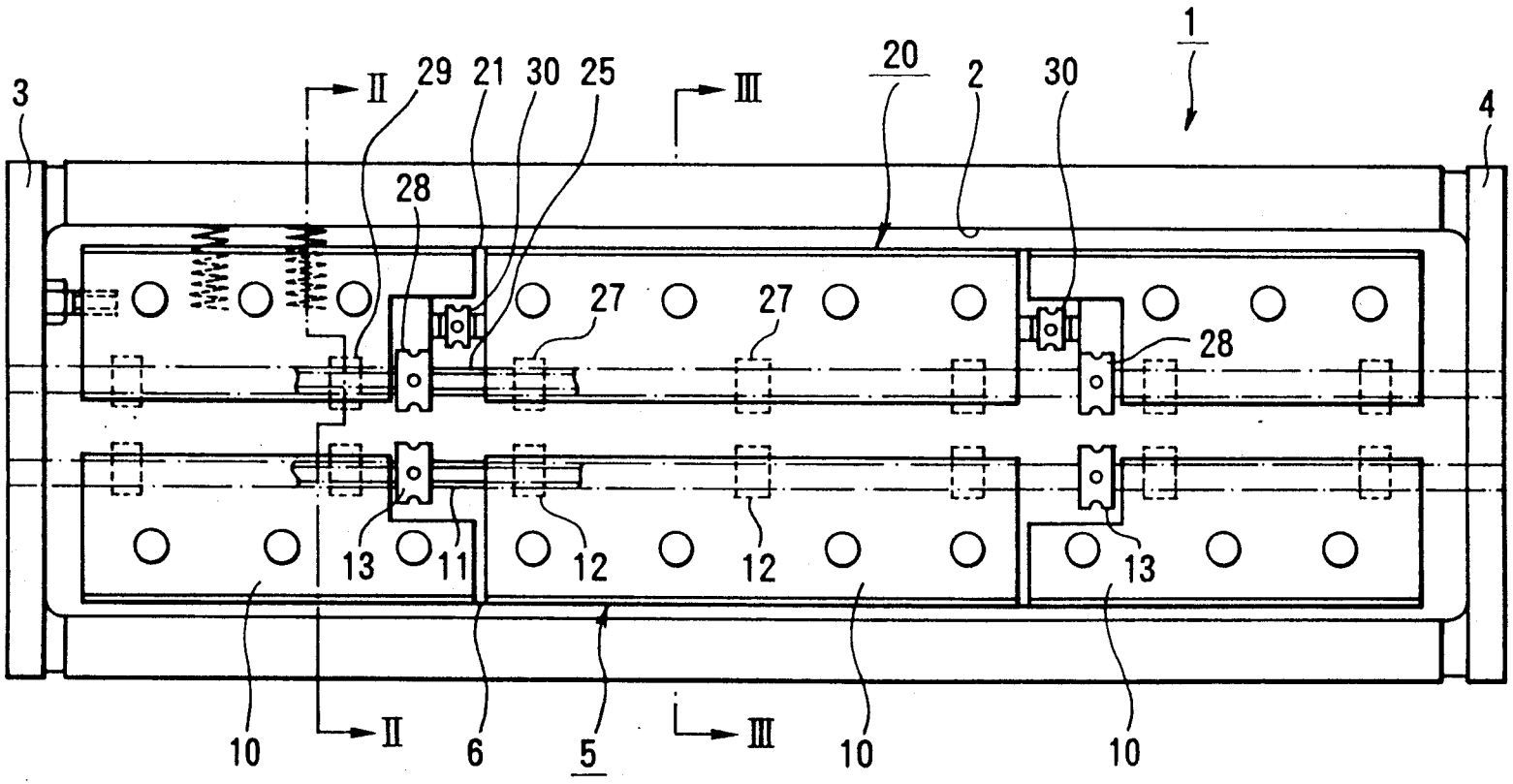
Figure 2:
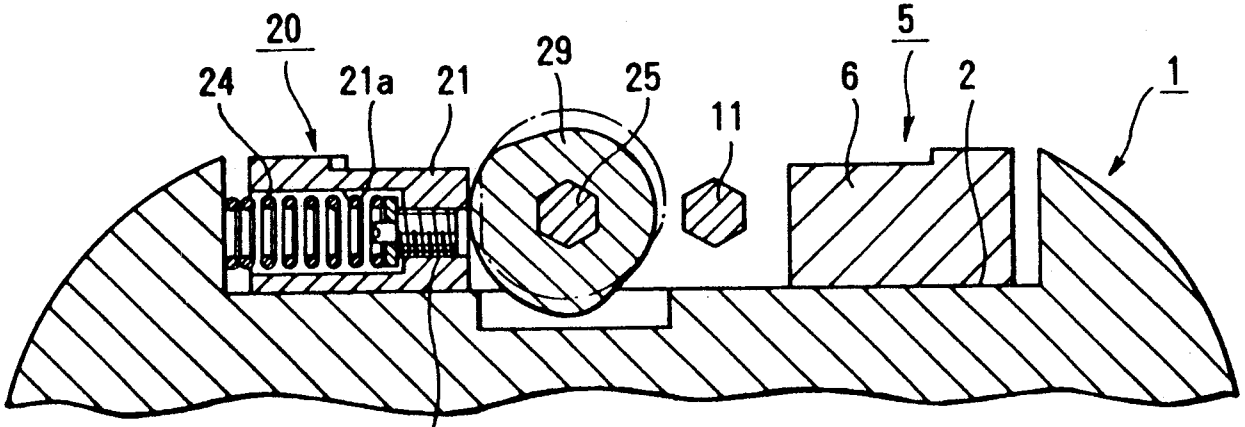
Figure 3:
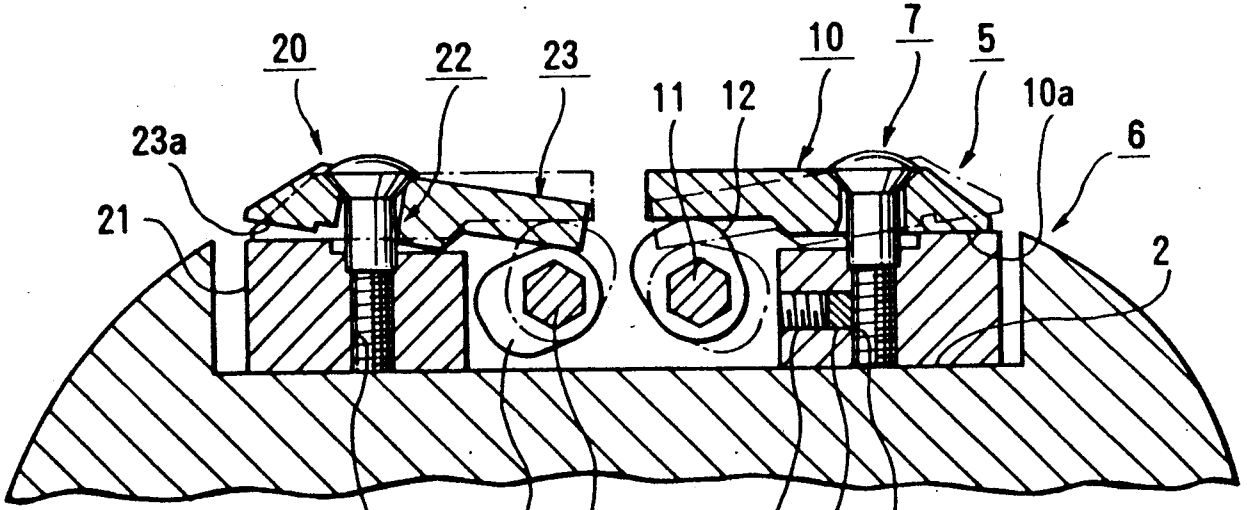

FIGS. 1 to 3 show an embodiment of a plate lockup apparatus for a printing press according to the present invention.

Referring to FIGS. 1 to 3, a gap 2 having an almost rectangular section is formed in the circumferential surface of a plate cylinder 1 along almost the overall length of the plate cylinder 1. Disc-like bearers 3 and 4 close both end portions of the gap 2. A leading-end plate lockup device 5 has a plate lockup table 6 formed to have almost a rectangular section and extending in the axial direction of the plate cylinder 1. Vertical movement of the plate lockup table 6 is limited by both end guides (not shown) disposed in the gap, but the plate lockup table 6 can be slightly moved in the circumferential direction. The plate lockup table 6 is movable in the circumferential direction of the plate cylinder 1. After the plate lockup table 6 is moved and adjusted, it is fixed by a fixing unit (not shown). A plurality of screw holes 6*a*are formed in the plate lockup table 6 along its longitudinal direction. Pins 7 each having a semispherical head are fitted in the screw holes 6*a* and are fixed by set screws 9 through resin chips 8, respectively. Three split gripper plates 10 having an overall length equal to that of the plate lockup table 6 are swingably supported such that holes of the gripper plates 10 are respectively fitted on the heads of the pins 7. Gripper surfaces 10*a* of the gripper plates 10 oppose the gripper surface of the plate lockup device 6. Although not shown, a plurality of linear projections are formed on the gripper surface 10*a*. The gripper surfaces 10*a* of the gripper plates 10 are biased in an open direction by spring members (not shown) interposed between the gripper plates 10 and the plate lockup table 6.

A plurality of bearings (not shown) are aligned at the central portion of the bottom surface of the gap 2 along the axial direction of the plate cylinder. A cam shaft 11 having a hexagonal section is pivotally supported on the bearings so that its portions having a circular section are fitted in the bearings. End portions having a circular section in the cam shaft 11 are pivotally supported on the bearers 3 and 4. A plurality of plate gripper cams 12 each having large- and small-diameter portions are aligned and mounted on the cam shaft 11 in the axial direction. A plurality of collars 13 are mounted on the cam shaft 11. When a wrench is fitted in a hole formed on the circumferential surface of each collar 13 on the cam shaft 11 and is turned, the large-diameter portions of the plate gripper cams 12 cause the gripper plates 10 to pivot clockwise against the elastic forces of the compression coil springs, thereby closing the gripper surfaces 10*a*.

A trailing-side plate lockup device 20 disposed parallel to the leading-side plate lockup device 5 in the gap 2 has a plate lockup table 21 having an almost rectangular section and extending in the axial direction of the plate cylinder 1. Vertical movement of the plate lockup table 2 is limited by end guides (not shown) in the gap, but the plate lockup table 21 can be slightly moved in the circumferential direction of the plate cylinder 1. A plurality of screw holes 22*a* are formed in the plate lockup table 21 along its longitudinal direction. Pins 22 each having a semispherical head are fitted in the screw holes 22*a* and are fixed, respectively. Three split gripper plates 23 having an overall length equal to that of the plate lockup table 21 are swingably supported such that holes of the gripper plates 23 are respectively fitted on the heads of the pins 22. Gripper surfaces 23*a* of the gripper plates 23 oppose the gripper surface of the plate lockup device 21. Although not shown, a plurality of linear projections are formed on the gripper surface 23*a*, The gripper surfaces 23*a* of the gripper plates 23 are biased in an open direction by spring members (not shown) interposed between the gripper plates 23 and the plate lockup table 21.

The plate lockup table 21 is formed to be movable in the circumferential direction of the plate cylinder 1 and is biased by compression coil springs 24 mounted in the spring holes 21*a* in a direction to come close to a cam shaft 25, i.e., in a plate tightening direction. Reference numerals 26 denote adjusting screws threadably engaged with the screw holes of the plate lockup table 21. The elastic forces of the compression coil springs 24 are adjusted by reciprocating the adjusting screws 26 upon turning of the adjusting screws 26.

A cam shaft 25 having a hexagonal section is pivotally supported by bearings (not shown) which support the cam shaft 11 at the central portion of the bottom surface of the gap 2 so that cam shaft portions having a circular section are fitted in the bearings. Cam shaft end portions having a circular section are pivotally supported on the bearers 3 and 4, respectively. A plurality of plate gripper cams 27 each having large- and small-diameter portions are aligned and mounted on the cam shaft 25 in the axial direction. A plurality of collars 28 are mounted on the cam shaft 25. When a wrench is fitted in a hole formed on the circumferential surface of each collar 28 on the cam shaft 11 and is turned, the large-diameter portions of the plate gripper cams 27 cause the gripper plates 23 to pivot clockwise against the elastic forces of the compression coil springs, thereby closing the gripper surfaces 23*a*.

Plate tightening cams 29 each consisting of large- and small-diameter portions are mounted on the cam shaft 25. Each plate tightening cam 29 is pivoted together with the cam shaft 25 to cause the small-diameter portion of the cam 29 to oppose an end face of the plate lockup table 21. The trailing-side plate lockup device 20 can be moved in a direction to separate the entire trailing-side plate lockup device 20 from the wall surface of the gap, i.e., in a plate tightening direction. The plate tightening cam 29 is pivoted together with the cam shaft 25 to cause the large-diameter portion of the cam 29 to oppose an end face of the plate lockup table 21. Therefore, the plate lockup table 21 is moved in a direction to cause the plate lockup table 21 to come close to the wall surface of the gap, i.e., a plate loosening direction. Fan-out bolts 30 in FIG. 1 prevent the trailing-side plate lockup device 20 from being deformed during plate tightening.

An operation of the plate lockup apparatus having the above arrangement will be described below. In the illustrated state, a wrench is fitted in the hole of the collar 13 on the cam shaft 11 and is turned. The plate gripper cams 12 are pivoted, and their small-diameter portions are brought into contact with the gripper plates 10. The gripper plates 10 are pivoted counterclockwise by elastic forces of the compression coil springs, so that the gripper surfaces 10*a* of the gripper plates 10 are open. One end of the plate is inserted between the griper surfaces 10*a* and the gripper surface of the plate lockup table 6. When the cam shaft 11 is then pivoted in a direction opposite to that described above, the plate gripper cams 12 are pivoted and their large-diameter portions are brought into contact with the gripper plates 10. The gripper plates 10 are pivoted clockwise against the elastic forces of the compression coil springs to close the gripper surfaces 10*a*, thereby gripping one end of the plate. In this case, uniform urging forces as gripper forces are applied from the plate gripper cams 12 to the gripping portions, respectively.

After one end of the plate is gripped, the plate cylinder 1 is rotated by about one revolution, and the plate is wound around the circumferential surface of the plate cylinder 1. A wrench is fitted in the hole of the collar 28 mounted on the cam shaft 25 to pivot the cam shaft 25. The plate gripper cams 27 are pivoted and their small-diameter portions are brought into contact with the gripper plates 23. The gripper plates 23 are pivoted clockwise by the elastic forces of the compression coil springs to open the gripper surfaces 23*a* of the gripper plates 23. The other end of the plate is then inserted between the gripper surfaces 23*a* and the plate lockup table 21.

After the insertion, the cam shaft 25 is pivoted in a direction opposite to that described above. The plate gripper cams 27 are pivoted and their large-diameter portions are brought into contact with the gripper plates 23. The gripper plates 23 are pivoted counter-clockwise against the biasing forces of the compression coil springs to close the gripper surfaces 23*a*, thereby gripping the other end of the plate. Uniform urging forces as gripper forces are applied from the plate gripper cams 27 to the gripping portions, respectively. At this time, the large-diameter portion of each plate tightening cam 29 is in contact with the plate lockup table 21, and the trailing-side plate lockup device 20 is located in a direction to cause the device 20 to come close to the wall surface of the gap 2. In this case, the plate is left loosened.

When a wrench is fitted in the hole of the collar 28 on the cam shaft 25 and is turned in the same direction, the small-diameter portions of the plurality of plate tightening cams 29 are simultaneously brought into contact with the end face of the plate lockup table 21 while the plate is kept gripped by the gripper surfaces 23*a*. The trailing-side plate lockup device 20 is moved by the elastic forces of the compression coil springs 24 in a direction to separate the device 20 from the wall surface of the gap 2. The plate is tightened and is brought into tight contact with the circumferential surface of the plate cylinder 1. In this case, since the plate is tightened by the elastic forces of the compression coil springs 24, the plate is uniformly tightened throughout its entire width.

When the plate is to be removed in this state, the cam shaft 25 is pivoted to bring the large-diameter portions of the plate tightening cam 29 into contact with the end face of the plate lockup table 21. The trailing-side plate lockup device 20 is moved toward the wall surface against the elastic forces of the compression coil springs 24, thereby loosening the plate. When the cam shaft 25 is further pivoted to bring the small-diameter portions of the plate gripper cams 27 into contact with the gripper plates 23, the gripper plates 23 are opened by the elastic forces of the compression coil springs. One end of the plate is released from the gripper plates. When the plate cylinder 1 is rotated by about one revolution, the plate can be unwound from the circumferential surface of the plate cylinder 1. When the cam shaft 11 is pivoted to bring the small-diameter portions of the plate gripper cams 12 into contact with the gripper plates 10, the gripper plates 10 are opened to release the other end of the plate, thereby completing removal of the plate.

As described above, gripping and release of both ends of the plate and plate tightening can be performed at one position upon pivotal movement of the cam shaft.

As is apparent from the above description, according to the present invention, since both ends of the plate can be gripped by the urging forces of the plate gripper cams, springs need not be replaced regardless of changes in thickness of the plate. The uniform gripper forces are applied to the plate throughout its entire width to improve gripping precision. In addition, cumbersome adjustment of the gripper plates need not be performed. Operations from plate gripping to plate release can be performed at one position. A preparation time can be shortened, and productivity can be increased. In addition, the present invention is compatible with the conventional plate lockup apparatus described above. The present invention can be achieved by easily modifying the existing plate lockup apparatus.

What is claimed is:

1. A plate lockup apparatus for a printing press, characterized by comprising:

a leading-side plate lockup table (6) axially extending on one side in a gap (2) of a circumferential surface of a plate cylinder (1) and a trailing-side plate lockup table (21) axially extending on the other side in the gap (2) of the circumferential surface of said plate cylinder (1);

leading- and trailing-side gripper plates (10, 23) pivotally supported to oppose said leading- and trailing-side plate lockup tables (6, 21) and biased in a plate release direction;

a plurality of plate gripper cams (12, 27), mounted on a plate tightening pivot shaft (11) and a trailing-side pivot shaft (25) parallel to said leading- and trailing-side gripper plates (10, 23) at equal intervals, for pivoting said leading- and trailing-side gripper plates (10, 23) in a plate gripping direction upon pivotal movement of said pivot shafts (11, 25);

spring members, interposed between said trailing-side plate lockup table (21) and a wall surface of said gap (2), for biasing said trailing-side plate lockup table (21) in a plate tightening direction; and plate tightening cams (29), mounted on said trailing-side pivot shaft (25), for moving said trailing-side plate lockup table (21) against the biasing forces of said spring members in a plate loosening direction.

2. An apparatus according to claim 1, wherein at least one of said leading- and trailing-side gripper plates (10, 23) is divided into a plurality of plates in an axial direction of said plate cylinder (1).

3. An apparatus according to claim 1, further comprising other spring members for biasing said leading- and trailing-side gripper plates (10, 23) in the plate release direction.

4. An apparatus according to claim 1, wherein said plate tightening cams (29) move said trailing-side plate lockup table (21) in the plate tightening direction upon pivotal movement of said trailing-side pivot shaft (25)

after said plate gripper cams (27) pivot said trailing-side gripper plates (23) in the plate gripping direction.

5. An apparatus according to claim 4, wherein said plate gripper cams (27) and said plate tightening cams (29) are interlocked and mounted on said trailing-side pivot shaft (25).

6. An apparatus according to claim 4, wherein said plate gripper cams (27) have a shape enough to keep pivoting said trailing-side gripper plates (23) in the plate gripping direction until said plate tightening cams (29) move said trailing-side plate lockup table (21) in the plate tightening direction upon pivotal movement of said trailing-side pivot shaft (25).

* * * * *

UNITED STATES PATENT AND TRADEMARK OFFICE

CERTIFICATE OF CORRECTION

PATENT NO. : 5,088,410

DATED : February 18, 1992

INVENTOR(S) : Toshiyuki Murakami

It is certified that error appears in the above-indentified patent and that said Letters Patent is hereby corrected as shown below:

Col. 3, line 66 change "2" to --21--;

Col. 4, line 12, change "23a," to --23a.--

Signed and Sealed this

Sixth Day of June, 1995

*Attest:*

*Attesting Officer*

BRUCE LEHMAN

*Commissioner of Patents and Trademarks*